US005761948A

United States Patent [19]

Malagnoux

[11] Patent Number: 5,761,948

[45] Date of Patent: Jun. 9, 1998

[54] MULTI-FUNCTIONAL PLIERS FOR MACHINE FINISHING

[75] Inventor: Roger Malagnoux, Domont, France

[73] Assignee: Etablissements Pierre Grehal Et. Compagnie SA, Val d' Oise, France

[21] Appl. No.: 766,246

[22] Filed: Dec. 13, 1996

[51] Int. Cl.[6] ..... B21D 28/10

[52] U.S. Cl. ..... 72/325; 72/409.12; 81/363

[58] Field of Search ..... 72/409.12, 409.14, 72/451, 325; 81/355, 362, 363

[56] References Cited

U.S. PATENT DOCUMENTS

| | | | |
|---|---|---|---|
| 1,811,452 | 6/1931 | Blalock | 81/362 |
| 2,892,368 | 6/1959 | Demler | 81/362 |
| 3,837,211 | 9/1974 | Gress | 72/409.12 |
| 4,526,070 | 7/1985 | Wiener | 81/362 |
| 5,287,716 | 2/1994 | Szulc | 72/409.12 |

FOREIGN PATENT DOCUMENTS

| | | | |
|---|---|---|---|
| 89784 | 12/1958 | Netherlands | 81/362 |

*Primary Examiner*—Daniel C. Crane

*Attorney, Agent, or Firm*—Robert W. Becker & Associates

[57] ABSTRACT

A multi-functional pliers has a body with a first fixed arm with a gripping portion. A second arm is connected with a first end to the body and has a gripping portion remote from the first end. The body has a pivot pin and the first end of the second arm is pivotably connected to the pivot pin. A blade is moveably mounted in the body. A toggle mechanism for transforming a rotary movement of the second arm into a translatory movement of the blade is provided. A returning part is connected to the body and a die member is connected thereto. The blade has a tool connected to one end thereof facing the die member. The first and second arms in a rest position of the pliers are positioned adjacent to one another such that the first and second arms can be gripped with one hand by a user, wherein by squeezing the fingers of the hand the second arm is moved toward the first arm. The toggle mechanism includes a control rod. The blade has an articulation pin to which the control rod is pivotably connected. The body has a fixed pivot member to which the control rod is pivotably connected. The toggle mechanism includes a transmission link for driving the control rod. The transmission link is connected with a first end to the second arm and with a second end to the control rod at a location between the articulation pin and the pivot member.

7 Claims, 2 Drawing Sheets

MULTI-FUNCTIONAL PLIERS FOR MACHINE FINISHING

BACKGROUND OF THE INVENTION

The present invention relates to multi-function pliers, in particular such pliers of a type enabling to make various machining works, by creating, according to needs, in particular in one or a plurality of superimposed iron sheets, a piercing or a puncturing of a hole with an over-turning of the edges of the hole, a crimping between a sleeve and an element surrounded by said sleeve, a cutting operation or the like.

It will more particularly be referred in this respect to European patent application EP-A-0 203 241, filed in the name of the assignee and which discloses a pliers of the above type, characterized in that it comprises a body that forms an arm provided with a handle, and a lever also provided with a handle and operated by bringing it closer to the arm. This lever is a part of a toggle joint suitable for controlling displacement of a sliding blade, guided by the body and placed in front of a die that is also carried by the body and against which is placed the iron sheet, the assembly of iron sheets or the part on which an operation of the type as hereinbefore mentioned is to be carried out by means of a suitable tool that is fixed at the end of the sliding blade.

The above mentioned European patent application shows in every useful details the structure, the working operations and the applications of the relevant multi-function pliers, permitting thereby to fully understand how it enables to make at will a piercing, a stamping or a punching in a part, or still a clipping or a crimping together of two parts, according to the type and shape of the tool that is carried by the blade.

As far as necessary, the content of this European patent application should be considered as an integral part of the present disclosure, the invention relating more to an improvement of the pliers mentioned in this publication, enabling to improve the operation thereof and to facilitate its application, while providing a unit that is still more effective and of an easy and reliable use, and which does not in particular require any particular technical ability or know-how on the part of the pliers' user.

Actually, in the anterior pliers, if the control of the sliding blade can be made in a simple and fast way, with a substantial reduction of the movement of the lever relative to the arm of the body, that is transmitted to the sliding blade so that the sliding blade can develop a high thrust force with a small stroke in order to pierce, stamp, crimp or punch parts that can have a great resistance, such as one or a plurality of sheets of steel or other like materials, the manner of actuation requires that the user will take the pliers with two hands, one hand taking the handle of the arm, the other hand that of the lever, to exert a force for bringing the two handles closer together that translates into the thrust provided to the blade.

Yet, for some more delicate works or for works that require greatest precision, it is not absolutely necessary to provide an important movement of the lever with respect to the arm, the same piercing or punching effect being, in various cases, obtainable with a more limited stroke and thrust of the sliding blade.

It is thus found that it is desirable to have a simpler tool which, while remaining of a same efficiency, will be easier to be used and, particularly, will not require the use of two hands, but only one hand, the tightening movement with the handles of the pliers enabling always to develop on the blade a suitable force, that is sufficient for accomplishing the desired machining operations.

SUMMARY OF THE INVENTION

For this purpose, the inventive pliers comprising a body provided with or having attached thereto a fixed first arm having one end with a gripping area or handle, and a second arm having also one end, opposite to the body, with a similar gripping area, this second arm being movable relatively to the body about a pivot pin carried by the body, and a toggle mechanism able to transform a rotary movement of the second arm into a translatory movement for a blade that slides in the body towards an oppositely placed die member that is also carried at the body by a returning part. The die member is designed for cooperating with a work tool that is mounted at that end of the blade facing towards the die member. The pliers are characterized in that the two arms of the pliers are sufficiently close to one another so as to be grippable together by only one user's hand, the movable arm being able to be brought closer to the fixed arm by a contraction of the fingers towards the palm, and in that the sliding blade comprises an articulation pin for a control rod, this control rod being rotatably mounted to the body on a fixed pivot member and driven in its movement by means of a return link articulated on the control rod, between the pivot member and the articulation pin, and on the movable second arm, respectively.

The multi-functional pliers according to the present invention is primarily comprised of:

- a body comprising a first arm with a gripping portion, the first arm fixed relative to the body;
- a second arm connected with a first end to the body and having a gripping portion remote from the first end;
- the body having a pivot pin and the first end of the second arm pivotably connected to the pivot pin;
- a blade moveably mounted in the body;
- a toggle mechanism for transforming a rotary movement of the second arm into a translatory movement of the blade;
- a returning part connected to the body;
- a die member connected to the returning part;
- the blade having a tool connected to one end thereof facing the die member;
- the first and the second arms in a rest position of the pliers positioned adjacent to one another such that the first and second arms can be gripped with one hand by a user, wherein by squeezing the fingers of the hand the second arm is moved toward the first arm;
- the toggle mechanism comprising a control rod;
- the blade comprising an articulation pin;
- the control rod pivotably connected with a first end thereof to the articulation pin;
- the body having a fixed pivot member and the control rod pivotably connected with a second end thereof to the fixed pivot member;
- the toggle mechanism further comprising a transmission link for driving the control rod;
- the transmission link connected with a first end to the second arm and connected with a second end to the control rod at a location thereof between the articulation pin and the pivot member.

The pliers further comprises a hairpin-shaped return spring mounted between the first and second arms for biasing the second arm away from the first arm.

The pliers further comprises a support stud fastened to the first arm, wherein the return spring has a central part engaging the support stud and further has a first leg (extension) secured at the first arm and a second leg (extension) secured at the second arm.

The control rod has an elongate groove extending in a longitudinal direction of the control rod and the pivot member engages the elongate groove so as to allow a movement of the control rod relative to the pivot member when actuating the pliers in order to displace the blade.

The body is U-shaped and has a first and a second side extending parallel to the blade for housing the blade therebetween, wherein the first side has an elongate aperture and the second side has an elongate aperture, the elongate apertures extending parallel to the blade, wherein the articulation pin engages the elongate apertures.

The blade has a central groove and the body has a fixed finger extending transversely between the first and second sides and engaging the central groove for parallel guiding the blade during displacement thereof when the pliers are actuated.

In a preferred embodiment of the invention, the pliers comprises a hair-pin shaped return spring, this return spring being mounted between the two arms, so to exert a permanent force on these two arms for biasing the mobile second arm away from the fixed first arm.

According to an additional feature, the return spring has a central part which is coiled around a support stud carried by the fixed first arm, the ends of the hair-pin being respectively fastened and immobilized at the two arms, respectively.

According to another feature of the inventive pliers, the fixed pivot member around which the control rod rotates, traverses a groove provided in the longitudinal direction of the control rod for allowing a small relative movement of the control rod with respect to the pivot member, following a displacement of the sliding blade, the sliding blade being itself connected to the control rod around the articulation pin.

According to still another feature, the body has a substantially inverted U-shaped cross section having sides that are parallel to the sliding blade housed therebetween, these sides each comprising an elongate aperture in which the articulation pin of the control rod on the blade is movable.

Lastly, the sliding blade itself comprises a central groove engaged by a fixed finger that is carried by the body and which extends transversely between its parallel sides, in order to provide a guiding of the sliding blade that remains permanently parallel to itself during the displacement thereof caused by movement of the control rod.

BRIEF DESCRIPTION OF THE DRAWINGS

Other features of a multiple-function pliers according to the invention will still appear in the course of the following description of an embodiment given as an indicative and non-limiting example by reference to the accompanying drawings, wherein.

DESCRIPTION OF PREFERRED EMBODIMENTS

Figure 1:
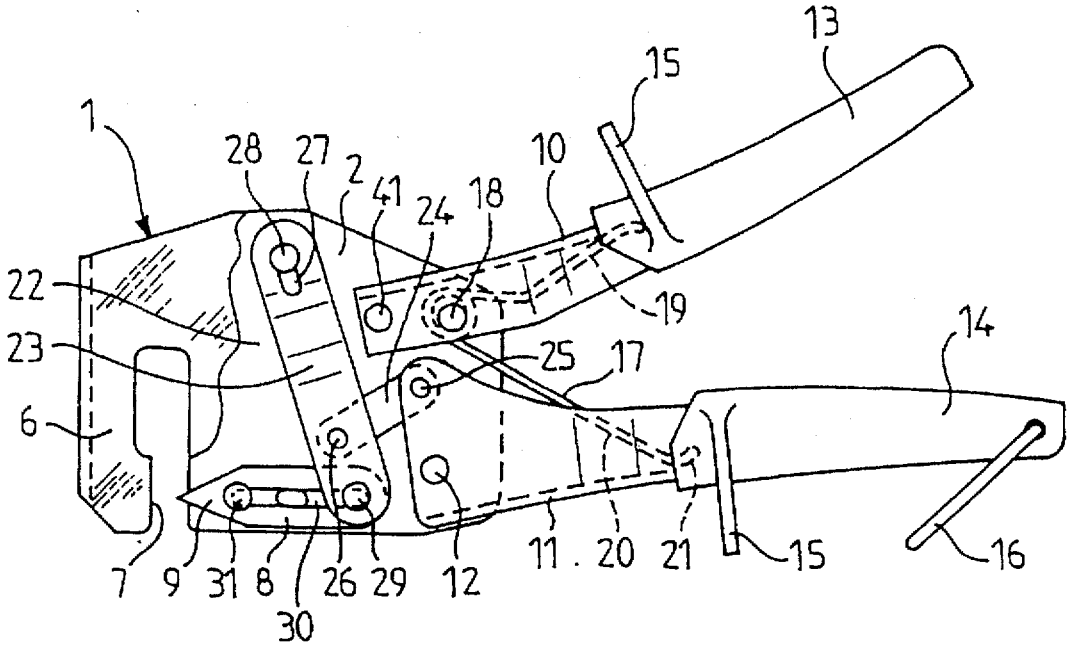
FIG. 1 is an elevation view of the inventive pliers, with its two arms being spaced apart relative to one another, the sliding blade being withdrawn into the interior of the body.
Figure 2:
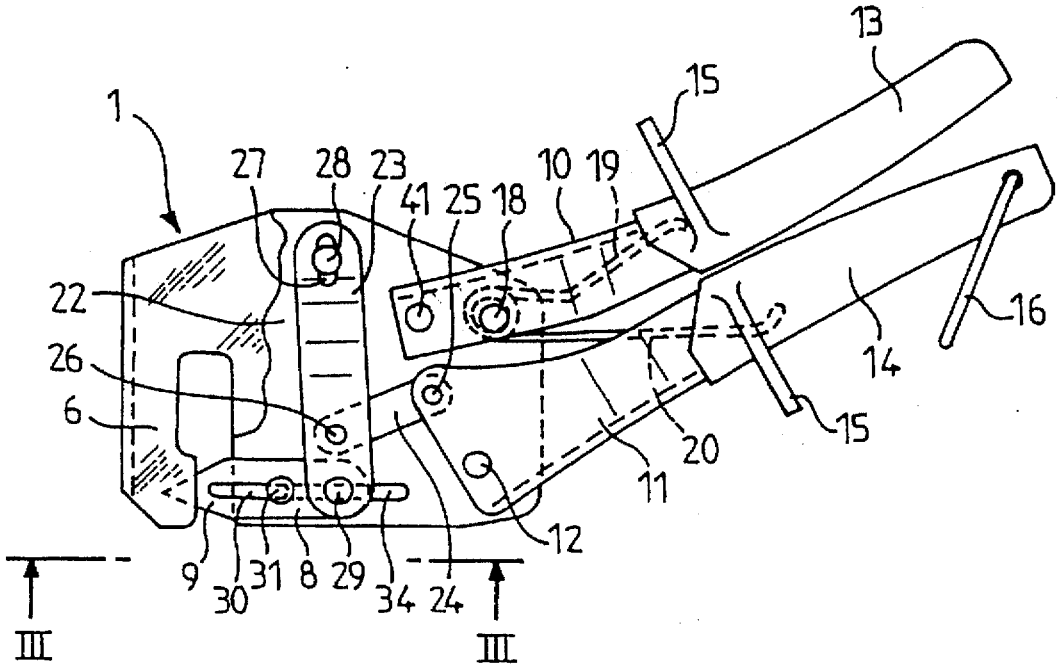
FIG. 2 is a view similar to FIG. 1, with the two arms brought closer together, the blade being moved for cooperating with the die member that is carried by the body.
Figure 3:
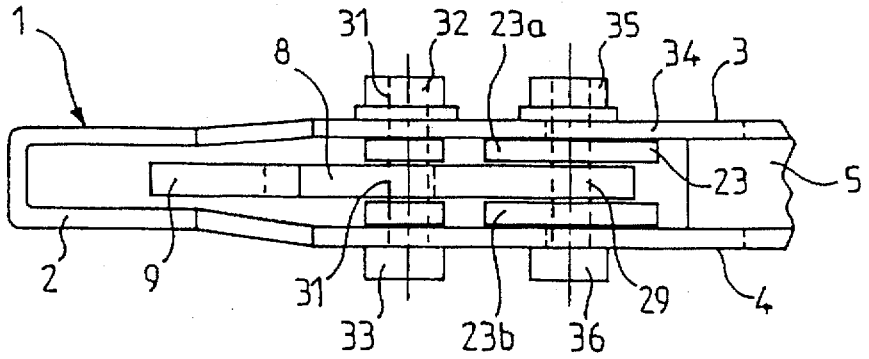
FIG. 3 is a cross sectional view, at an enlarged scale, taken along line III—III of FIG. 2.

As shown more particularly in FIGS. 1–3, the inventive pliers comprises a body 1, made of a metal part 2, suitably bent or shaped according to the manufacturing process that is used for making the shape of an inverted U, with its sides 3 and 4, respectively, parallel to each other and forming therebetween a slot or central housing 5 (see more particularly FIG. 3).

In general, the body 1 as shown is similar to that already described in the published European patent application EP-A-0 203 241 with, in particular, a forward returning part 6 that forms a die member 7, which is provided for cooperating with a sliding blade 8. The construction and mounting of the blade will be hereinafter described. This blade comprises, opposite the die member 7, an active part or tool 9, provided to cooperate with this die member in a manner as disclosed later on.

The tool 9 may be integrally formed with the sliding blade 8, thereby forming the corresponding end thereof (as shown in the figures of the shown embodiment) or, as a variant, may be a separate part and fixed to the blade by any suitable means.

In a way which is also similar to that disclosed in the above mentioned patent application, the pliers comprises an equivalent of the fixed handle and the mobile lever provided in this prior realization, but in an embodiment that is by itself very different and provides to these pliers an improved effectiveness.

For this purpose, the body 1 comprises a first fixed arm 10 and a second movable arm 11 that is articulated on the body 1 about a pin 12, these two arms comprising, at their ends opposite the body 1, two handles 13 and 14 enabling a user of the pliers to hold these pliers firmly with only one hand, for exerting on the movable arm 10 a force for bringing it closer to the fixed arm 10, as shown respectively in FIGS. 1 and 2 in which the arms are, in one case, shown separated, and in the other case practically in contact with one another.

Each of the handles 13 and 14 may comprise, in a manner known per se, a laterally protruding member 15 that forms an abutment for the fingers and the thumb of the hand holding the pliers, the two arms being held by the palm. One of the handles may further comprise a ring 16 for suspending the pliers from a rack member or similar structure.

The two arms 10 and 11 of the pliers are associated with an intermediate return spring 17, preferably having the general shape of a hair-pin. Its top is coiled around an articulation stud 18, that is carried by the fixed arm 10 in the illustrated example, the two extensions 19 and 20 of the hair-pin shaped spring 17 being attached and immobilized by suitable means on the two arms 10 and 11, respectively.

Advantageously, each one of the arms 10 and 11 may have a profile that is cut away in its median part for forming a slot in which is housed each one of the two extensions 19 and 20, for securing the spring 17 and preventing any lateral movement thereof, without interfering with the movement of the two arms toward and away from one another. In particular, the ends of these extensions 19 and 20 may have a bent part 21 which engages an immobilization hole (not shown) provided in each one of the arms.

Controlling the pliers, and in particular moving the sliding blade 8 and tool 9 carried thereby, is possible by means of a toggle mechanism generally shown at 22.

The toggle mechanism 22 comprises principally a control rod 23, which is connected to a transmission link 24, itself articulated on the movable arm 11 at pin 25 and on the control rod 23 at pin 26. The pins 25, 26 are parallel.

The control rod 23 comprises, at its end that is opposite to the sliding blade 8, a groove 27 that extends longitudinally to the control rod 23. A fixed pivot member 28, carried by the body 1, engages the groove 27 so that the control rod 23 can rotate with respect to the pivot member 28 while permitting a slight relative movement with respect to the pivot member which rides in the groove 27, as this is clearly shown by comparing FIGS. 1 and 2.

At its end that is opposed to the fixed pivot member 28, the control rod 23 is also articulated around a pin 29 on the sliding blade 8, which sliding blade comprises a central groove 30 that extends in the direction of movement of the blade. A guiding finger 31 extends through the groove 30 and is fixed, on both sides and externally of the parallel lateral sides 3 and 4 of the body 1, by means of locking bolts 32 and 33 (FIG. 3).

Lastly, an elongate aperture 34 is likewise provided in each one of the sides 3 and 4 of the body 1. The two elongate apertures 34 are both identical and parallel to the central groove 30 of the sliding blade 8, and receive respectively the ends of the articulation pin 29 between the control rod 23 and the sliding blade 8, which ends can again be advantageously secured by means of nuts 35 and 36 (see also FIG. 3).

In the drawings and in particular in the cross sectional view of FIG. 3, there is shown that the control rod 23 is preferably made of two parts, 23*a* and 23*b* respectively, to form a stirrup overlapping the sliding blade 8 that is housed therebetween so as to distribute the forces exerted on the sliding blade 8 via the pin 29. Obviously, the two parts 23*a* and 23*b* may extend over the entire length of the control rod 23, or may be joined to a single unit at the level of the fixed pivot member 28 at is opposed end.

Figure 4:
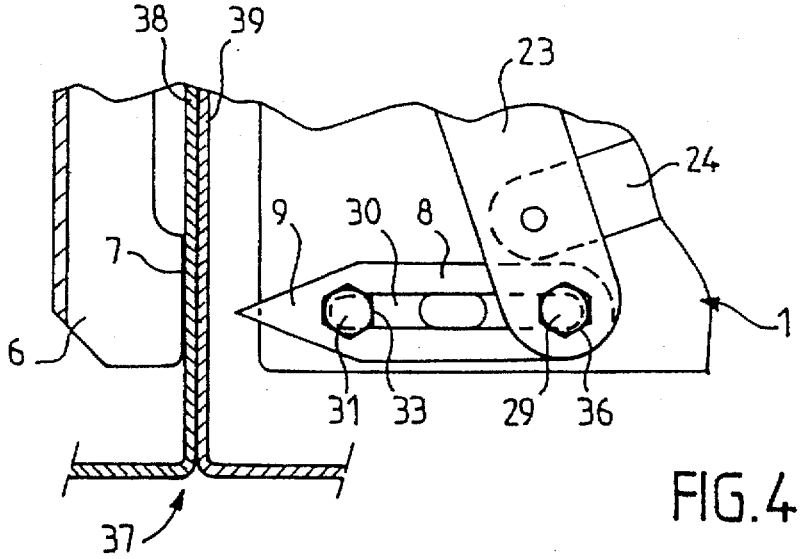
FIGS. 4 and 5 are detail views, also at an enlarged scale, showing how a tool, attached to or integrally formed at the sliding blade, is adapted to make a puncture with overturning of the edges in two superimposed iron sheets.
Figure 5:
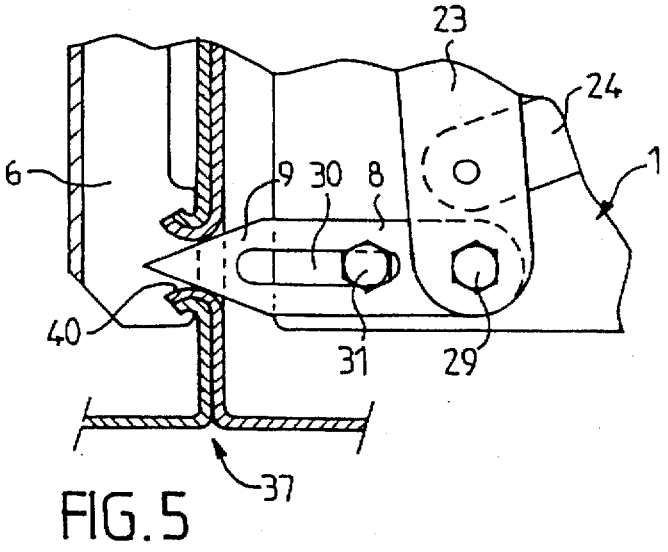
Figure 6:
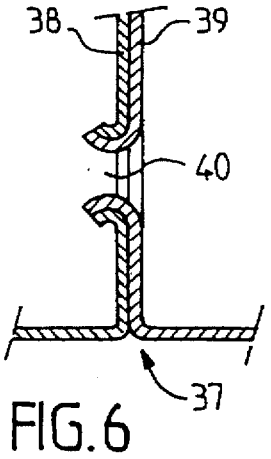
FIG. 6 illustrates the profile of the iron sheets of FIGS. 4 and 5 after use and withdrawal of the inventive pliers.

FIGS. 4, 5 and 6 make possible to fully understand the operation of the pliers according to the invention, in particular for making a simultaneous puncture in an assembly 37 formed of two superimposed iron sheets, 38 and 39 respectively, bearing on the die 7 of the returning part 6 of the body 1. FIG. 4 shows the corresponding assembly before the tool 9 makes the desired puncture 40, illustrated in FIG. 5 and still better shown in FIG. 6, after the pliers has been withdrawn, with a mutual over-lapping and outwardly overturning of the edges of the hole so made.

There is thus realized a multi-function pliers of a simple design and which has a great effectiveness in its working, being in particular able to be worked with only one hand. The toggle mechanism 22 formed by the control rod 23, the link 24 and the sliding blade 8 enables to develop on the sliding blade 8—which remains always parallel to itself thanks to the elongate apertures 34 and the guiding groove 30—an important thrust, even for a relatively limited movement stroke of the movable arm 11 with respect to the fixed arm 10.

Obviously, it is clear that the invention is not limited to the example of the embodiment more particularly hereinabove described with reference to the accompanying drawings; on the contrary it covers all the variants.

In particular, it has been mainly provided in this example that the arm 10 was fixed to the body 1. In fact, it is possible to provide that the arm is itself articulated at a pin 41 carried by the body 1, so as to facilitate moving it closer to the movable arm 11, the stroke of which must however remain sufficient to permit the suitable move of the control rod 23.

The present invention is, of course, in no way restricted to the specific disclosure of the specification and drawings, but also encompasses any modifications within the scope of the appended claims.

What I claim is:

1. A multi-functional pliers comprising:

a body comprising a first arm with a gripping portion, said first arm fixed relative to said body;

a second arm connected with a first end to said body and having a gripping portion remote from said first end;

said body having a pivot pin and said first end of said second arm pivotably connected to said pivot pin;

a blade moveable mounted in said body;

a toggle mechanism for transforming a rotary movement of said second arm into a translatory movement of said blade;

a die member connected to said body;

said blade having a tool connected to one end thereof facing said die member;

said first and said second arms in a rest position of said pliers positioned adjacent to one another such that said first and second arms can be gripped with one hand by a user, wherein by squeezing the fingers of the hand said second arm is moved toward said first arm;

said toggle mechanism comprising a control rod;

said blade comprising an articulation pin;

said control rod pivotably connected with a first end thereof to said articulation pin;

said body having a fixed pivot member and said control rod pivotably connected with a second end thereof to said fixed pivot member;

said toggle mechanism further comprising a transmission link for driving said control rod;

said transmission link connected with a first end to said second arm and connected with a second end to said control rod at a location thereof between said articulation pin and said pivot member: and wherein said control rod has an elongate groove extending in a longitudinal direction of said control rod and wherein said pivot member engages said elongate groove so as to allow a movement of said control rod relative to said pivot member when actuating said pliers in order to displace said blade.

2. A pliers according to claim 1, further comprising a hairpin-shaped return spring mounted between said first and second arms for biasing said second arm away from said first arm.

3. A pliers according to claim 2, further comprising a support stud fastened to said first arm, wherein said return spring has a central part engaging said support stud and further has a first leg secured at said first arm and a second leg secured at said second arm.

4. A multi-functional pliers comprising:

a body comprising a first arm with a gripping portion, said first arm fixed relative to said body;

a second arm connected with a first end to said body and having a gripping portion remote from said first end;

said body having a pivot pin and said first end of said second arm pivotably connected to said pivot pin, a blade moveably mounted in said body;

a toggle mechanism for transforming a rotary movement of said second arm into a translatory movement of said blade;

a die member connected to said body;

said blade having a tool connected to one end thereof facing said die member;

said first and said second arms in a rest position of said pliers positioned adjacent to one another such that said first and second arms can be gripped with one hand by a user, wherein by squeezing the fingers of the hand said second arm is moved toward said first arm;

said toggle mechanism comprising a control rod;

said blade comprising an articulation pin;

said control rod pivotably connected with a first end thereof to said articulation pin;

said body having a fixed pivot member and said control rod pivotably connected with a second end thereof to said fixed pivot member;

said toggle mechanism further comprising a transmission link for driving said control rod;

said transmission link connected with a first end to said second arm and connected with a second end to said control rod at a location thereof between said articulation pin and said pivot member; and wherein said body is U-shaped and has a first and a second side extending parallel to said blade and housing said blade therebetween, wherein said first side has an elongate aperture and said second side has an elongate aperture, said elongate apertures extending parallel to said blade, wherein said articulation pin engages said elongate apertures.

5. A pliers according to claim 4, wherein said blade has a central groove and wherein said body has a fixed finger extending transversely between said first and second sides and engaging said central groove for parallel guiding said blade during displacement thereof when said pliers are actuated.

6. A pliers according to claim 4, further comprising a hairpin-shaped return spring mounted between said first and second arms for biasing said second arm away from said first arm.

7. A pliers according to claim 6, further comprising a support stud fastened to said first arm, wherein said return spring has a central part engaging said support stud and further has a first leg secured at said first arm and a second leg secured at said second arm.

* * * * *